United States Patent [19]

Grunert

[11] 4,391,478

[45] Jul. 5, 1983

[54] DRAWER SEAL

[75] Inventor: Hans C. Grunert, Adelberg, Fed. Rep. of Germany

[73] Assignee: Sybron Corporation, Rochester, N.Y.

[21] Appl. No.: 149,573

[22] Filed: May 14, 1980

[51] Int. Cl.[3] ..... A47B 77/00; A47B 87/00; A47B 88/00

[52] U.S. Cl. ..... 312/320; 206/408; 312/296

[58] Field of Search ..... 312/296, 320; 206/408

[56] References Cited

U.S. PATENT DOCUMENTS

| | | | |
|---|---|---|---|
| 699,179 | 5/1902 | Hurley | 312/296 |
| 864,083 | 8/1907 | Cranston | 312/296 |
| 2,217,222 | 10/1940 | Hall | 312/296 UX |
| 4,040,695 | 8/1977 | Brann | 312/320 |
| 4,231,626 | 11/1980 | Amtmann | 312/320 |

*Primary Examiner*—Robert I. Smith

*Attorney, Agent, or Firm*—Robert A. Gerlach; Roger Aceto; John B. Mason

[57] ABSTRACT

Drawers for storage units such as dental cabinets are provided with a sealing system that eliminates the need for seal mounting partitions between vertically stacked drawers. Flexible seal members are attached to upper drawer handles, and these flexible sealing members contact the top of the next lower drawer handle when the drawers are closed, thus sealing the space between the drawers.

5 Claims, 4 Drawing Figures

DRAWER SEAL

BACKGROUND OF THE INVENTION

This invention relates to a drawer seal that increases the effective storage space for a given cabinet height.

Cabinet drawers, such as those used to store medical or dental instruments, have been provided with seals to keep dust, airborne bacteria and similar contaminants out of the drawers when they are closed. Typical cabinets of this sort have used a flexible seal, mounted on the cabinet case, around the entire periphery of each drawer. This provides an effective seal, but in typical installations, which may include two or more drawers above one another, partitions for mounting the seals must be provided between the individual drawers. This decreases the effective storage space for a given cabinet height, which is a drawback in certain situations.

For example, in modern dentistry the dentist and his assistant are usually seated beside the patient. Drawers containing their instruments and materials should be accessible with a minimum amount of movement. Thus, it is generally desirable to keep the cabinets containing these items as compact as possible.

SUMMARY OF THE INVENTION

This invention eliminates the need for partitions between the drawers by using the drawer handle as a part of the sealing system. Flexible sealing members are attached to each upper drawer handle, and these sealing members contact the next lower drawer handle when the drawers are closed. Thus, there is no need for mounting partitions between the individual drawers and the effective storage space for a given cabinet height is increased.

DRAWINGS

DETAILED DESCRIPTION

The illustrated cabinet includes a case containing drawers 20, 30, 40, 50 adapted to hold dental instruments, supplies or the like. The drawers are mounted on runners (not shown) attached to the side of case 11 or to a central vertical divider 12.

Figure 1:
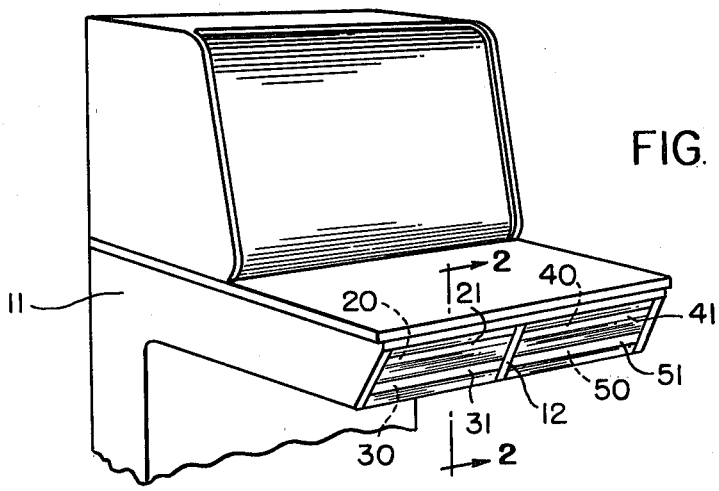
FIG. 1 is a perspective view of a dental cabinet embodying this invention.
Figure 2:
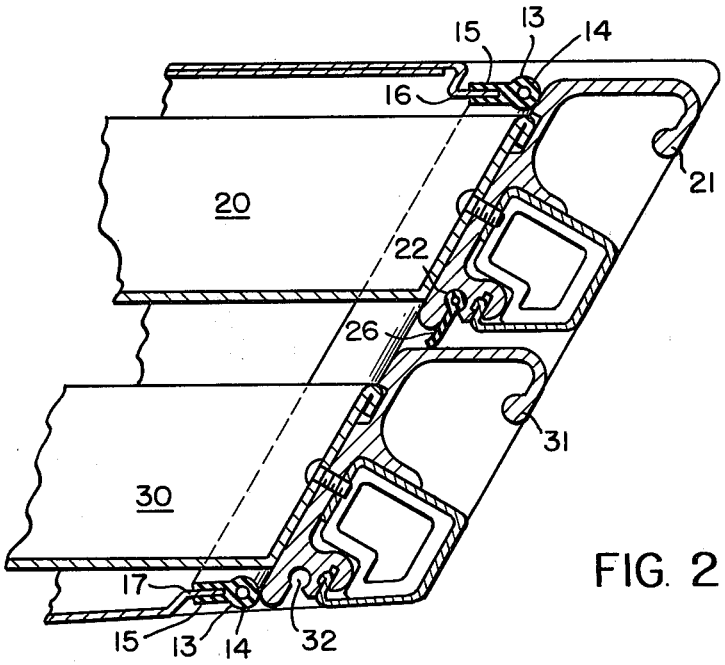
FIG. 2 is a cross-sectional left elevation view along lines 2—2 of FIG. 1.

Each drawer has a handle 21, 31, 41, 51 which, in addition to providing a grip for opening and closing the drawer, forms part of the sealing system. As may be seen in FIGS. 2 and 3, there is a groove 22, 32 in each drawer handle. Flexible sealing members 26 are mounted in the grooves in the upper drawer handles 21, 41. These flexible sealing members 26 contact the tops of the lower drawer handles 31, 51 when the drawers are closed, thus sealing the openings between the upper and lower drawers.

A conventional flexible peripheral seal 13 closes the spaces above the upper drawer 20, below the lower drawer 30, and on both sides of drawers 20 and 30. A similar conventional seal (not shown) closes the spaces around drawers 40 and 50. Peripheral seal 13 has a flexible tubular sealing section 14 that contacts the top of drawer handle 21, the bottom of drawer handle 31 and the side edges of each drawer handle when the drawers are closed. A mounting channel 15 extends from the tubular sealing section 14 and slides onto sheet metal supports 16, 17, 18, attached respectively to the top of case 11, the bottom of the case, and either the side of the case or the central vertical divider 12. Preferably, the seal 13 is a single unitary member that extends along the top of drawer 20, the bottom of drawer 30 and each side of both drawers. This seal may be made of a number of conventional elastomeric materials, such as rubber, polyvinyl chloride, rubber sponge or the like. Preferably, the tubular sealing section 14 is relatively soft, and the mounting channel 15 is somewhat harder to obtain a better fit.

When drawers 20 and 30 are closed, seals 26 and 13 close substantially all of the open spaces around the drawers. Thus, dust, bacteria and other airborne contaminants are effectively excluded from the closed drawers.

Figure 3:
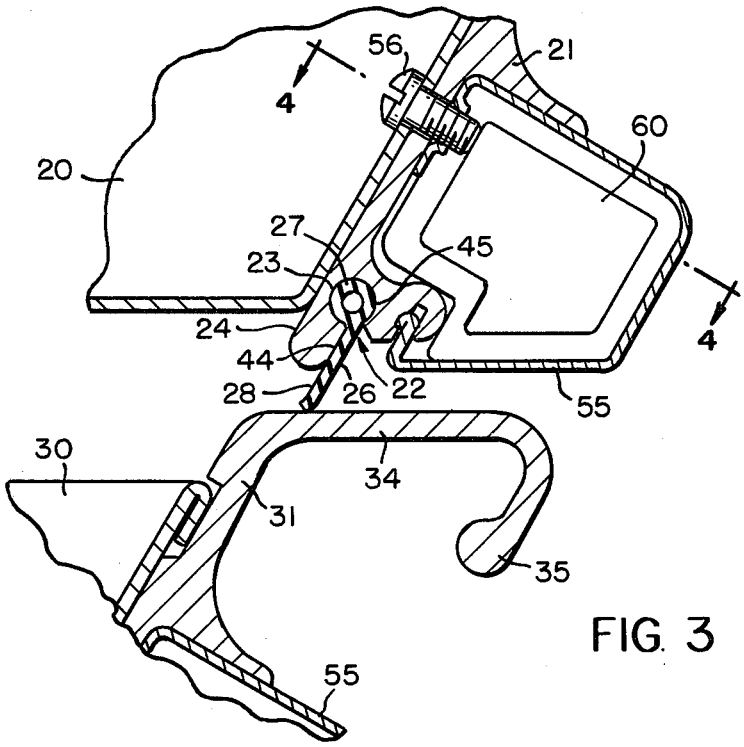
FIG. 3 is an enlarged cross-sectional elevation detailed view from the same vantage point as FIG. 2.
Figure 4:
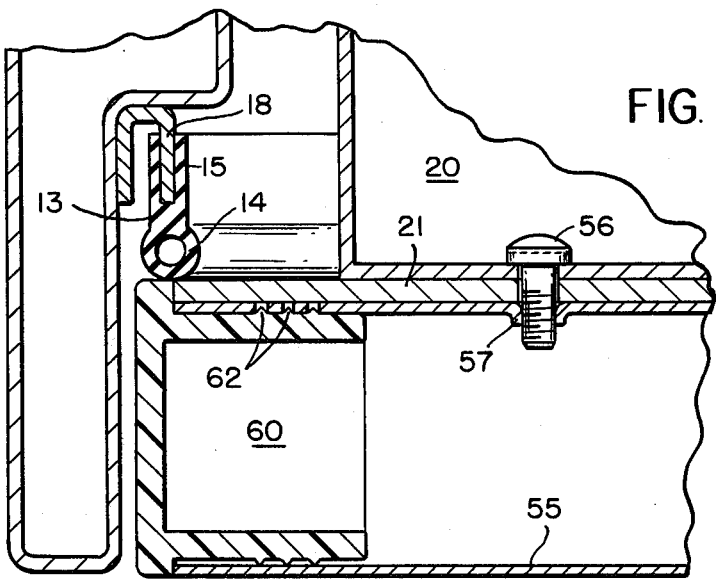
FIG. 4 is an enlarged cross-sectional detailed view along lines 4—4 of FIG. 3.

FIGS. 3 and 4 illustrates some structural features of preferred drawer handles, and the attached flexible seals 26, in greater detail. As may be seen from FIG. 3, the preferred mounting grooves 22 include a tubular mounting channel 23 with a slot 24 at the bottom of the channel. The preferred flexible sealing members 26 include a tubular mounting section 27, mounted in channel 23, and a flap 28, attached to the tubular mounting sections 27, that extends through slot 24 and contacts the top of lower drawer handle 31. The flexible sealing member 26, like the peripheral seals 13, may be made of various conventional elastomers.

The preferred mounting grooves 23 also include a support wall 44 extending down behind slot 24. Support wall 44 supports the sealing flap 28 as the lower drawer 30 is closed. A shorter support wall 45 extends down ahead of slot 24. This wall does not need to be as long as the rear support wall 44 because a decorative insert plate 55, discussed below, supports the sealing flap as the upper drawer is closed. Preferably, the angle between the support walls 44 and 45 is approximately 50°, with an angle of about 65° between each support wall and the top surface of the lower drawer handle.

Each drawer handle includes a substantially horizontal plate 34, with a lip 35 depending therefrom that provides a handhold. The flat plate 34 provides a substantially horizontal surface that helps insure effective sealing contact with the flexible sealing member 26.

Each drawer handle also has a second groove 52 that supports one end of the decorative metal insert plate 55 mentioned above. The other end of the insert plate 55 is attached to the handle 31 with bolts 56 extending through elliptical mounting holes 57 in the insert plate. These mounting bolts 56 also attach the handle 31 to the front of the drawer 30. As was mentioned above, the bottom end of the decorative insert plate is preferably positioned so that the plate 55 supports the sealing flap 28 as the upper drawer 20 is closed.

The openings at the ends of each handle, between the main portion of the handle and the decorative insert plate 55, are closed with molded caps 60. As may be seen in FIG. 4, ridges 62 on the caps and complementary slots in the decorative insert plates 55 hold the caps in place. The lower part of the handles and the decorative insert plates are slightly shorter than the upper part of the handles. Thus, the ends of the insert cap 60 are flush with the upper side edge of the handle.

The main portion of the handle is preferably of extruded aluminum. The main portion of the illustrated handle is preferably of extruded aluminum, milled to receive the end caps. The entire handle, including the ends, may also be molded plastic. As may be appreciated from the foregoing description, all other parts of the invention can also be produced economically, using conventional techniques. Thus, this invention provides a practical, economic means for providing a drawer sealing system which eliminates the need for seal mounting partitions between vertically stacked drawers, which increases the effective storage space available for a given cabinet height. Stated another way, this invention reduces the cabinet height required to produce a given amount of storage space.

Since all parts of this invention can be produced economically using conventional techniques, the invention also provides considerable flexibility in adapting the invention to different applications. Many variations may be made in the embodiment described about within the scope of the invention, which is defined by the following claims.

I claim:

1. In a storage unit comprising a case, a plurality of drawers arranged in the case in a vertically stacked array, each drawer having a handle for moving the drawer into and out of the case including a first handle attached to a first drawer and a second handle attached to a second drawer stacked immediately below the first, an improved system for sealing between and about the vertically stacked drawers comprising:

(a) each of said handles extending substantially across the full width of its associated drawer and each handle having an upper portion with a relatively flat upper surface and a lower portion;

(b) a flexible seal member carried by and depending from the lower portion of said first handle, said sealing member being adapted to contact the flat upper surface of said second handle along substantially the full width of said second handle when the drawers associated with said first and second handles are closed; and (c) sealing means on said cabinet extending about the periphery of said vertically stacked array of drawers, said sealing means contacting the upper portion of the upper-most handle in said drawer array, the lower portion of the lower-most handle in said drawer array and the side edges of each handle in said drawer array.

2. A storage unit as in claim 1 wherein each handle has a tubular channel extending the full width of said lower portion and an open slot communicating with said channel, said flexible seal member comprising:

(a) a tubular mounting section within said channel; and (b) a flexible flap extending from said tubular mounting section and trough said slot to contact against the upper surface of the handle immediately below.

3. A storage unit as in claim 2 wherein each handle has a first wall extending downward from said lower portion behind said slot to provide support for the flexible flap of said seal member carried by said lower portion.

4. A storage unit as in claim 1 wherein the upper portion of each handle includes a plate extending substantially outward from said drawer which defines said relatively flat upper surface and a lip depending from said plate to provide a handhold.

5. A storage unit as in claim 1 wherein said handle forms the front wall of each drawer.

* * * * *